US006655378B2

(12) United States Patent
Swetish

(10) Patent No.: US 6,655,378 B2
(45) Date of Patent: Dec. 2, 2003

(54) SNORKEL

(75) Inventor: Thomas R. Swetish, Racine, WI (US)

(73) Assignee: Johnson Outdoors Inc., Racine, WI (US)

( * ) Notice: Subject to any disclaimer, the term of this patent is extended or adjusted under 35 U.S.C. 154(b) by 122 days.

(21) Appl. No.: 09/927,923

(22) Filed: Aug. 10, 2001

(65) Prior Publication Data

US 2003/0029448 A1 Feb. 13, 2003

(51) Int. Cl.[7] ..... B63C 11/02
(52) U.S. Cl. ..... 128/201.11; 128/201.27
(58) Field of Search ..... 128/200.24, 201.11, 128/201.27, 202.14, 203.23, 206.29, 207.14

(56) References Cited

U.S. PATENT DOCUMENTS

| | | | | |
|---|---|---|---|---|
| 908,690 | A | 1/1909 | Neubert | |
| 1,946,126 | A | 2/1934 | Black | |
| 2,317,236 | A | 4/1943 | Wilen et al. | |
| 2,362,240 | A | 11/1944 | Bonilla | |
| 2,362,775 | A | 11/1944 | Sebouh | |
| 2,534,568 | A | 12/1950 | Bedini et al. | |
| 3,141,469 | A | 7/1964 | Stradella | |
| 3,721,235 | A | 3/1973 | Ball et al. | |
| 4,071,024 | A | 1/1978 | Blanc | |
| 4,278,080 | A | 7/1981 | Schuch | 128/201.11 |
| 4,610,246 | A | 9/1986 | Delphia | 128/201.11 |
| 4,655,212 | A | 4/1987 | Delphia | 128/201.11 |
| 4,782,830 | A | 11/1988 | Forman | 128/201.11 |
| 4,793,341 | A | 12/1988 | Arasmith | |
| 4,805,610 | A | 2/1989 | Hunt | |
| 4,834,084 | A | 5/1989 | Walsh | 128/201.11 |
| 4,860,739 | A | 8/1989 | Vandepol | 128/201.11 |
| 4,872,453 | A | 10/1989 | Christianson | |
| 4,879,995 | A | 11/1989 | Christianson | |
| 4,884,564 | A | 12/1989 | Lamont | |
| 4,896,664 | A | 1/1990 | Harayama | |
| 5,027,805 | A | 7/1991 | Kung | 128/201.11 |

(List continued on next page.)

FOREIGN PATENT DOCUMENTS

| | | |
|---|---|---|
| EP | 0 377 919 | 7/1990 |
| EP | 0 775 628 | 5/1997 |
| EP | 0 816 220 | 1/1998 |
| FR | 959.096 | 3/1950 |
| IT | 413009 | 3/1946 |

(List continued on next page.)

OTHER PUBLICATIONS

PCT International Search Report of International Application No. PCT/US 02/04433 (3 pages).

*Primary Examiner*—Glenn K. Dawson
(74) *Attorney, Agent, or Firm*—Foley & Lardner

(57) ABSTRACT

A snorkel including a mouthpiece, a tube and a sealing member is disclosed. The tube extends from the mouthpiece and includes a first end proximate the mouthpiece, a second end and at least one internal passageway having a port proximate the second end. The sealing member is slidably coupled to the tube proximate the second end and is sealed about the tube. The sealing member moves between a closed position in which the member occludes the port and an open position in which the port is open. The sealing member has an interior in communication with the at least one internal passageway when the sealing member is in the closed position. In the exemplary embodiment, the sealing member is sealed to the tube via a flexible membrane. In an exemplary embodiment, the flexible membrane preferably includes a bellows. In the exemplary embodiment, the sealing member defines a first sealing surface which engages a second sealing surface proximate the port to seal the port along the first seal line that defines a first area. The sealing member is sealed against the tube along a second seal line that defines a second area, wherein the first area is greater than the second area.

20 Claims, 5 Drawing Sheets

U.S. PATENT DOCUMENTS

| | | | | | |
|---|---|---|---|---|---|
| 5,092,324 | A | | 3/1992 | Christianson | 128/201.11 |
| 5,101,818 | A | | 4/1992 | Chace et al. | 128/202.14 |
| 5,117,817 | A | | 6/1992 | Lin | |
| 5,199,422 | A | | 4/1993 | Rasocha | 128/201.11 |
| 5,239,990 | A | | 8/1993 | Delphia | 128/201.11 |
| D339,399 | S | | 9/1993 | Lin | |
| D339,400 | S | | 9/1993 | Lin | |
| 5,261,396 | A | | 11/1993 | Faulconer et al. | 128/201.11 |
| 5,265,591 | A | | 11/1993 | Ferguson | 128/201.11 |
| 5,267,556 | A | | 12/1993 | Feng | 128/201.11 |
| 5,280,785 | A | | 1/1994 | Fujima | 128/201.11 |
| 5,297,545 | A | | 3/1994 | Infante | 128/204.18 |
| 5,404,872 | A | | 4/1995 | Choi | 128/201.11 |
| 5,487,379 | A | | 1/1996 | Koshiishi | 128/201.11 |
| 5,622,165 | A | | 4/1997 | Huang | 128/201.11 |
| 5,657,746 | A | | 8/1997 | Christianson | 128/201.11 |
| 5,664,558 | A | | 9/1997 | Wagner | 128/201.11 |
| 5,671,728 | A | | 9/1997 | Winefordner et al. | 128/201.11 |
| 5,865,169 | A | | 2/1999 | Lan et al. | 128/201.11 |
| D406,333 | S | | 3/1999 | Garraffa | |
| 5,893,362 | A | * | 4/1999 | Evans | 128/201.11 |
| 5,906,199 | A | * | 5/1999 | Budzinski | 128/201.11 |
| 5,960,791 | A | | 10/1999 | Winefordner et al. | |
| 6,073,626 | A | | 6/2000 | Riffe | 128/201.11 |
| 6,079,410 | A | | 6/2000 | Winefordner et al. | 128/201.11 |
| 6,085,744 | A | | 7/2000 | Hermansen et al. | 128/201.11 |
| D433,128 | S | | 10/2000 | Winefordner et al. | |
| 6,129,081 | A | | 10/2000 | Wu | 128/201.11 |
| 6,276,362 | B1 | | 8/2001 | Chen-Lieh | 128/201.11 |
| 6,302,102 | B1 | | 10/2001 | Giroux et al. | 128/201.11 |
| 6,318,363 | B1 | | 11/2001 | Monnich | 128/201.11 |
| 6,363,929 | B1 | | 4/2002 | Winefordner et al. | 128/201.11 |
| 6,371,108 | B1 | | 4/2002 | Christianson | 128/201.11 |

FOREIGN PATENT DOCUMENTS

| | | |
|---|---|---|
| IT | 524692 | 4/1955 |
| IT | 712617 | 9/1966 |
| JP | 5-193560 | 8/1993 |
| JP | 8-67297 | 3/1996 |
| JP | 9-30491 | 2/1997 |
| JP | 10-53192 | 2/1998 |
| JP | 10-53193 | 2/1998 |
| JP | 10-203481 | 8/1998 |
| JP | 11-227688 | 8/1999 |
| JP | 2001-058596 | 3/2001 |
| JP | 2002-154480 | 5/2002 |
| WO | WO 9603313 | 7/1995 |
| WO | WO 00/09391 | 2/2000 |
| WO | WO 03/013953 | 2/2003 |

* cited by examiner

SNORKEL

FIELD OF THE INVENTION

The present invention relates to snorkels. In particular, the present invention relates to a snorkel which automatically seals its air portal when submerged.

BACKGROUND OF THE INVENTION

Snorkels are used during snorkeling to provide the user with air as the user at least partially submerges his or her head below the water surface. Snorkels typically include one or more elongate tubes which are connected at one end to a mouthpiece and which include one or more air ports at an opposite end. Air passes through the air portal through the tube to the mouthpiece where the air is inhaled by the user. The exhaled air by the snorkeler also passes through the tube.

During snorkeling, the water surface will many times be choppy and rough due to wind and various other causes. As a result, the water surface frequently rises up such that water undesirably passes through the air port. To avoid accidental swallowing of the water, the user must either forcefully blow the water out of the air tube or out of the snorkel tube or remove and tip the snorkel tube to empty the water.

Due to such problems associated with basic snorkels, snorkels have been developed that shield the air portal from waves or which seal the air portal of the snorkel tube. Although snorkels which shield the air portal may be effective in preventing waves of water from flowing into the tube through the air portal, such shields are ineffective when the user intentionally or unintentionally submerges the top of the snorkel and its air portal below the water surface. As a result, alternative snorkels have been developed which actually seal the air portal when the snorkel is lowered below or submerged below the water surface. Such alternative snorkels, known as "dry snorkels", typically employ a buoyant float (such as a foam member or hollow ball) which rises as the snorkel is being submerged to seal the air portal of the snorkel. Although commonly used during snorkeling activities, such dry snorkels have several drawbacks. First, because such dry snorkels rely on a buoyant member or float, such dry snorkels are incapable of sealing the air port when the snorkel itself is inverted or turned sideways such as during a dive. Secondly, such dry snorkels typically require an extremely convoluted air passageway. As a result, breathing through such dry snorkels is difficult and laborsome. Thirdly, such dry snorkels are typically complicated, requiring multiple parts and costly assembly.

Thus, there is a continuing need for a snorkel that (1) prevents waves of water from passing through the air portal of the snorkel tube, (2) that seals the air portal when submerged, regardless of the orientation of the snorkel tube itself, (3) that utilizes a simpler, more direct air passageway to provide easier breathing, and (4) that is simple, requires fewer parts and is easy to manufacture.

SUMMARY OF THE INVENTION

According to one embodiment of the present invention, a snorkel includes a tube having a first end, a second end, and at least one internal passageway having a port. The snorkel additionally includes a hollow member slidably supported proximate the first end. The hollow member moves between a closed position in which the member occludes the port and an open position in which the port is open. The hollow member has an interior in communication with the internal passageway when the hollow member is in the closed position.

According to another exemplary embodiment, a snorkel includes a mouthpiece, a tube coupled to the mouthpiece, a first sealing surface, a sealer member and a flexible membrane. The tube includes a first end, a second end proximate the mouthpiece and at least one internal passageway having a port and extending from the first end to the second end. The first sealing surface extends above the port. The sealer member extends about the tube below the port and includes a second sealing surface. The flexible membrane is sealed to the sealer member and the tube. The sealer member moves between an open position in which air is allowed to pass through the port into the internal passageway and a closed position in which the second sealing surface engages the first sealing surface to block the port.

According to another exemplary embodiment, a snorkel includes a mouthpiece, a tube coupled to the mouthpiece, a lid, a sealer member, and a flexible membrane. The tube includes a first end, a second end proximate the mouthpiece, and at least one internal passageway having a port and extending from the first end to the second end. The lid is coupled to the tube proximate the first end and provides a first sealing surface. The sealer member extends about the tube and provides a second sealing surface opposite the first sealing surface. The sealer member moves between a closed position in which the second sealing surface engages the first sealing surface to block the port and an open position in which air is allowed to pass through the port into the internal passageway. The sealer member includes an interior in communication with the internal passageway when the sealer member is in the closed position. The flexible membrane is sealed to the sealer member and the tube.

DETAILED DESCRIPTION OF THE PREFERRED EMBODIMENTS

Figure 1:
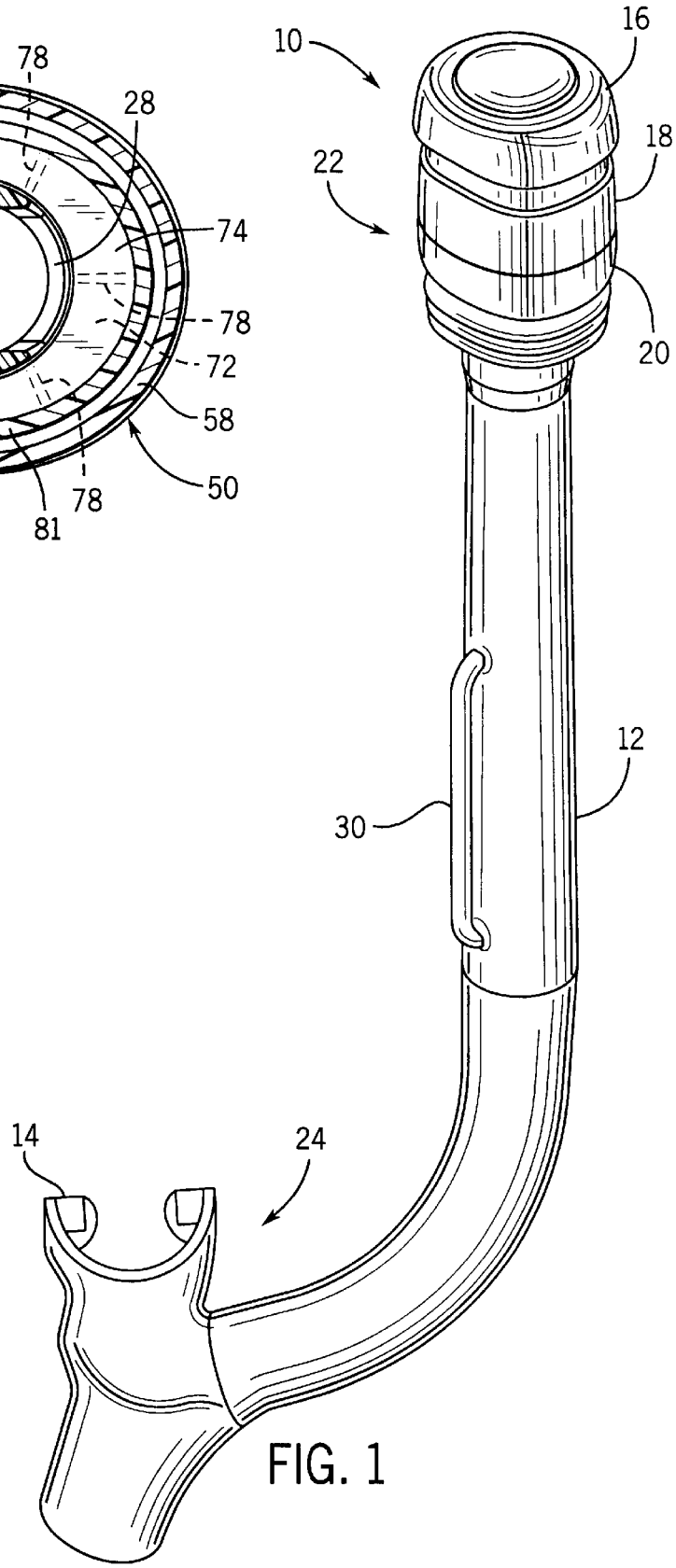
FIG. 1 is a perspective view of a snorkel being an exemplary embodiment of a snorkel of the present invention.

FIG. 1 is a perspective view of an assembled snorkel 10. Snorkel 10 generally includes tube 12, mouthpiece 14, lid 16, sealer member 18 and movable seal 20. Tube 12 generally comprises an elongate tube composed of one or more segments and including an upper end 22, a lower end 24 and at least one internal passageway 26 (shown in FIG. 4) extending between ends 22 and 24 and pneumatically communicating with mouthpiece 14 at end 24 and with at least one port 28 (shown in FIG. 4) at end 22. In the exemplary embodiment, tube 12 provides a single air passageway 26. Alternatively, tube 12 may provide multiple air passages extending at least partially between ends 22 and 24, wherein the multiple air passages provide distinct passageways used independently of one another when inhaling and exhaling. As best shown by FIG. 1, tube 12 is preferably J-shaped and includes a loop 30 along its exterior configured to receive a strap or other portion of a face mask or goggles to secure the face mask or goggles to snorkel 10. Tube 12 may alternatively have alternative shapes or configurations extending between ends 22 and 24 and may have alternative exterior appearance. Tube 12 functions to pass air from above the water surface to below the water surface during inhaling by the snorkeler, and to allow for the discharge of exhaled air from the snorkeler.

Mouthpiece 14 is conventionally known and mounted to a lower end 24 of tube 12. Mouthpiece 14 communicates with the internal passageway 26. Mouthpiece 14 enables the snorkeler to intake air from tube 12 during inhaling and also enables the snorkeler to exhale air which is either discharged through an opening in mouthpiece 14 or through an alternative opening along or on top of tube 12. Mouthpiece 14 may have a variety of sizes, shapes and configurations other than the exemplary mouthpiece 14 depicted in FIG. 1.

Lid 16 comprises a structure coupled to end 22 of tube 12 adjacent to and preferably above port 28. Lid 16 provides a sealing surface 32 (shown in FIG. 4) against which sealer member 18 seals against and occludes port 28 in that port 28 no longer communicates between passageway 26 and an exterior of snorkel 10. In the exemplary embodiment, lid 16 also provides a shield to block ingress of water of into passageway 26.

Sealer member 18 comprises a member extending at least partially about tube 12 proximate end 22. Sealer member 18 is sealed at one end to tube 12 and includes a sealing surface 34 (shown in FIG. 4) which is configured and located to cooperate with sealing surface 32 to occlude port 28. Sealing member 18 moves relative to tube 12 between an open position in which air is allowed to pass through port 28 into internal passageway 26, and a closed position in which sealing surfaces 32 and 34 are in engagement with one another to block or occlude port 28.

Movable seal 20 seals sealer member 18 to and about tube 12 while at the same time permits sealer member 18 to move between the open position and the closed position. Movable seal 20 preferably comprises a flexible membrane sealed to and about tube 12 at a first portion and coupled to sealer member 18 at a second portion. Movable seal 20 preferably comprises a bellows. Alternatively, movable seal 20 may comprise a flexible membrane in other configurations such as a generally cylindrical sleeve or balloon sealed about tube 12 along a first portion and coupled to sealer member 18 along a second portion. Moreover, although less desirable, movable seal 20 may alternatively comprise other conventionally known or later developed means for providing a generally watertight seal between two adjacent structures while at the same time permitting relative movement between the adjacent structures.

Figure 3:
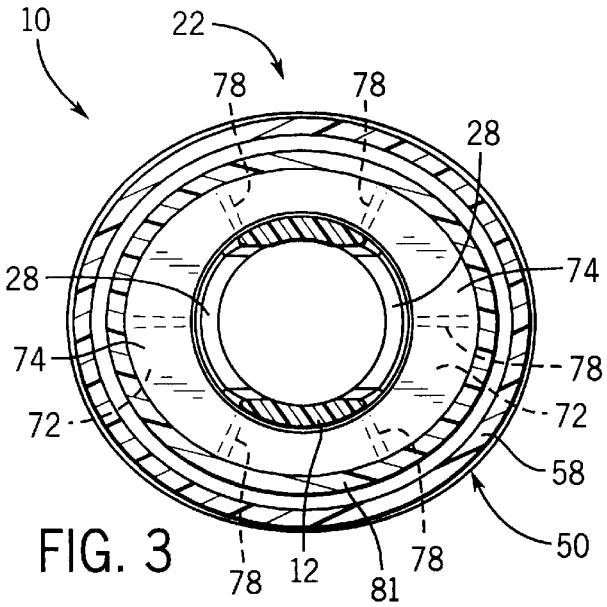
FIG. 3 is a sectional view of the snorkel of FIG. 4 taken along line 3—3.
Figure 2:
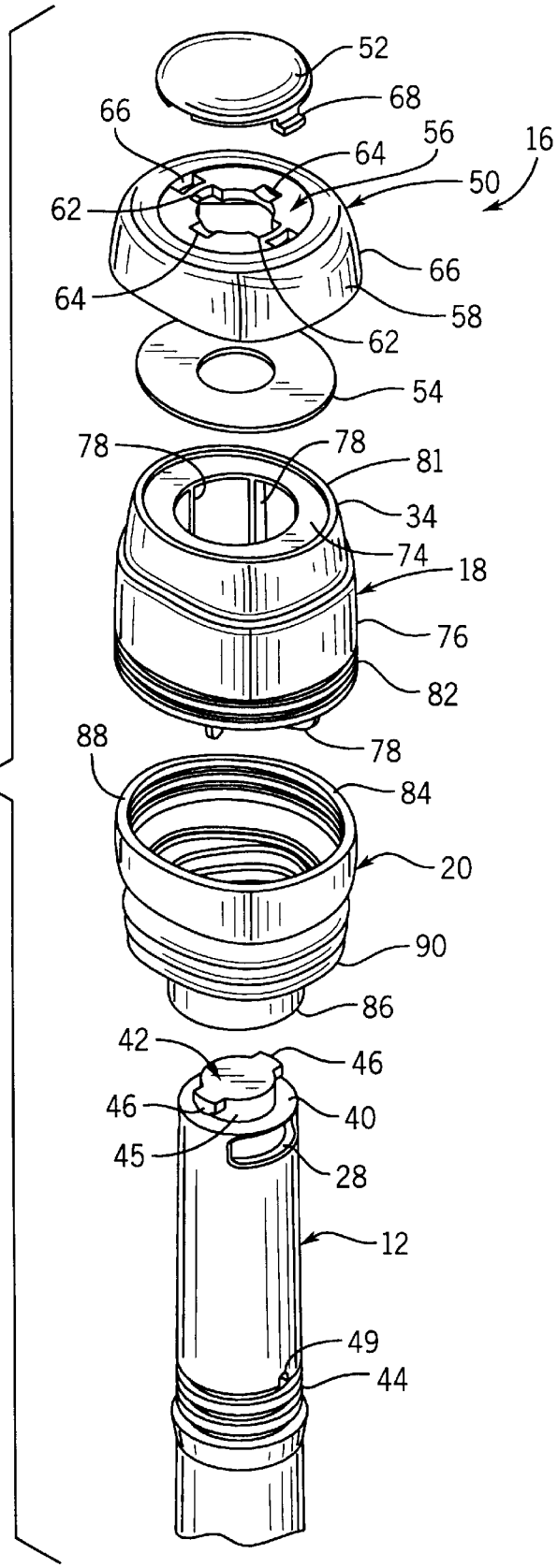
FIG. 2 is a fragmentary exploded perspective view of the snorkel of FIG. 1.
Figure 4:
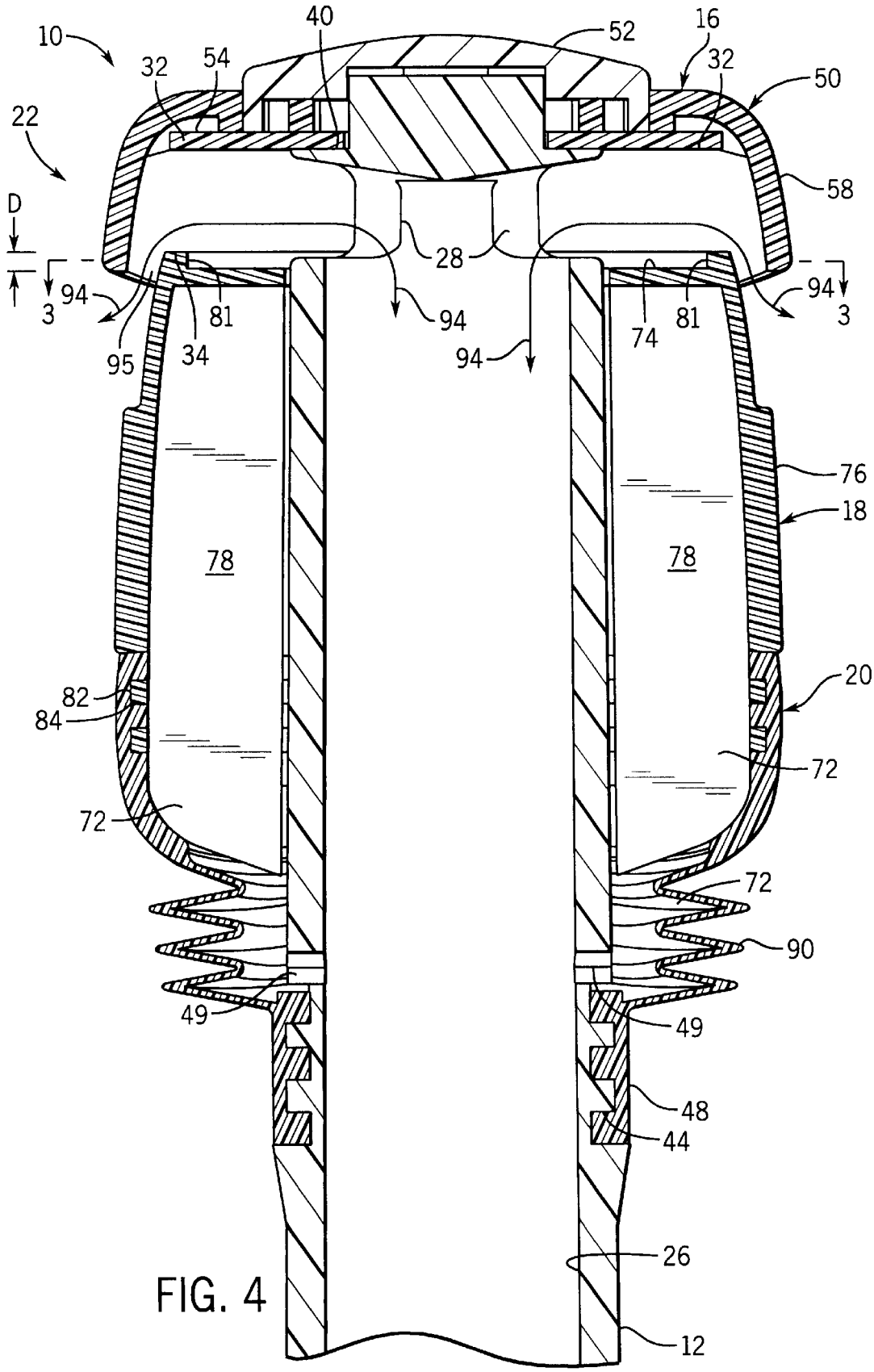
FIG. 4 is a fragmentary sectional view of the snorkel of FIG. 1 in an open position and taken along a longitudinal center of the snorkel.

FIGS. 2–5 illustrate snorkel 10 in greater detail. FIG. 2 is an exploded fragmentary perspective view of a top of snorkel 10. FIG. 3 is a sectional view of snorkel 10 taken along line 3—3 of FIG. 4. FIG. 4 is a sectional view of snorkel 10. As best shown by FIGS. 2 and 3, end 22 of tube 12 preferably includes a closed axial top 40, mounting structure 42, and external ribbed portion 44. Top 40 extends above ports 28 and supports mounting structure 42. Mounting structure 42 projects upwardly from top 40 and generally comprises a hub 45 and a pair of outwardly extending ears 46. Structure 42 is configured to mount and secure lid 16 to top 40 of tube 12 without the need for adhesives, welding or additional fasteners. Although less desirable, lid 16 may be mounted to top 40 of tube 12 by such methods. Moreover, although top 40 and hub 45 are illustrated as being preferably integrally formed as part of a single unitary body with tube 12, such structures may alternatively be mounted to tube 12 by any of the aforementioned methods. Although snorkel 10 is illustrated as including ports 28 which extend in a radial direction through the walls of tube 12, ports 28 may alternatively comprise a single port or greater than two ports. In addition, ports 28 may alternatively extend axially through an end of tube 12 or at an angle through tube 12 in alternative embodiments.

External ribbed portion 44 generally comprises external ribs formed on an exterior surface of tube 12 at a location spaced from top 40 below ports 28. Ribbed portion 44 sealingly engages internal ribs 48 of movable seal 20 to facilitate the mounting and sealing of movable seal 20 to tube 12 below ports 28. In particular applications, a sealing compound may be additionally provided between ribbed portion 44 and ribs 48 to provide additional sealing. Although less desirable, movable seal 20 may alternatively be sealingly secured and mounted to and about the external surface of tube 12 by various other means such as welding, adhesives, press fits, mechanical locks and the like.

As shown by FIG. 4, tube 12 additionally includes an optional drain hole 49. Drain holes 49 comprise passageways extending opposite one another through the walls of tube 12. Drain holes 49 communicate between passageway 26 of tube 12 and the interior of sealer member 18. Drain holes 49 permit water trapped within the interior of sealer member 18 to drain into passageway 26 and to be expelled by the snorkeler.

As further shown by FIGS. 2 and 3, lid 16 generally includes shield 50, cap 52 and seal ring 54. Shield 50 generally comprises a downwardly extending cup-shaped member having a top portion 56 and a downwardly extending perimeter 58. Top portion 56 is configured to be mounted to mounting structure 42 of tube 12 and generally includes central opening 60, ear passages 62, ear detents 64 and cap apertures 66. Central opening 60 extends through top 56 and is sized to receive hub 45 of structure 42 and such that top 56 bears against top 40 of tube 12. Ear passages 62 radially extend outwardly from central opening 60 and are sized to receive ears 46 of structure 42 to allow ears 46 to pass through top 56. Ear detents 64 generally comprise depressions or recesses extending into an upper surface of top portion 56. Detents 64 are sized to partially receive ears 46 of structure 42 and are preferably annularly spaced from ear passages 62 by 90 degrees. As a result, shield 50 may be easily mounted to top 40 of tube 12 without additional fasteners. In particular, ears 46 are inserted through ear openings 62. Tube 12 and shield 50 are then rotated 90 degrees relative to one another to position ears 46 in detents 64, thereby securing shield 50 to tube 12.

Cap 52 mounts to and over top portion 56 of shield 50 and generally includes two tabs 68 which snap into cap apertures 66 of top 56 to secure cap 52 to shield 50. Cap 52 prevents accidental dislodgment of shield 50 from tube 12 and provides for a sleek aesthetic appearance along the top of snorkel 10.

Downwardly extending perimeter 58 extends from top 56 towards end 24 of tube 12. Perimeter 58 is preferably dimensioned so as to extend from above to below ports 28 when shield 50 is mounted upon tube 12. Perimeter 58 blocks waves of water from undesirably entering passageway 26 of tube 12 through ports 28.

Seal ring 54 generally comprises an annular ring of a material which is capable of forming a seal with another member when the other member bears against it. In the exemplary embodiment, ring 54 is formed from a compressible or elastomeric material such as silicone. Alternatively, ring 54 may be formed from other materials such as flexible vinyl or polyvinyl chloride. Ring 54 extends about hub 45 and is preferably captured between the upper surface of top 40 of tube 12 and a lower surface of top portion 56 of shield 50. Ring 54 preferably has an outer diameter sufficiently sized such that ring 54 provides sealing surface 32 (shown in FIG. 4) against which surface 34 of sealer member 18 bears against and forms a seal when sealer member 18 is in a closed position.

The exemplary embodiment of lid 16 enables lid 16 to be mounted to tube 12 without adhesive, welding or other fasteners. In addition, the described structure enables seal ring 54 to be removed and replaced when necessary. The structure also provides a sleek and attractive aesthetic design. Although less desirable, lid 16 may have a variety of alternative configurations. For example, shield 50 and cap 52 may alternatively be integrally formed as part of a single unitary body which are snapped onto top 40 of tube 12 or which are permanently or releasably coupled to top 40 of tube 12 by other securement means such as welding, adhesives, or by fasteners. In lieu of being captured between shield 50 and top 40 of tube 12, seal ring 54 may alternatively be fastened to shield 50 by welding, fasteners, adhesives and the like. Moreover, seal ring 54 may alternatively be co-molded as part of shield 50 or press fit to shield 50. Although less desirable, seal ring 54 may be omitted in embodiments where shield 50 itself has a generally flat surface opposite surface 34 of sealer member 18 so as to provide a sealing surface in lieu of surface 32 currently provided by seal ring 54. In such an alternative embodiment, surface 34 is preferably formed from a sealing material such as a soft or compressible material, an elastomeric material or a rubber-like material. In such an alternative embodiment, surface 34 preferably includes silicone.

Sealer member 18 generally comprises a member slidably supported along end 22 of tube 12 and configured to move between a closed position in which surface 34 of sealer member 18 engages surface 32 of lid 16 to occlude or block ports 28 and an open position. In the exemplary embodiment, sealer member 18 also cooperates with movable seal 20 to form a hollow member that has an interior 72 in communication with passageway 26 of tube 12 when sealer member 18 is in the closed position. In the exemplary embodiment illustrated, sealer member 18 includes top 74, sidewall 76 and ribs 78. Top 74 and sidewalls 76 are preferably integrally formed as part of a single unitary body and define a generally cup-shaped body. Top 74 includes an opening 80 through which tube 12 extends. Top 74 additionally includes an upwardly projecting lip 81 which forms sealing surface 34. Sidewall 76 includes external ribs 82 configured to sealingly engage internal ribs 84 of movable seal 20 to sealably couple sealer member 18 to movable seal 20. Alternatively, sealer member 18 may be sealably affixed to movable seal 20 by various other methods such as welding, adhesives, threads, mechanical interlocks or mechanical fasteners. In lieu of comprising two separate components, sealer member 18 may alternatively be integrally formed or co-molded with movable seal 20 out of one or more materials.

Ribs 78 are preferably integrally formed with top 74 and sidewalls 76 and extend inwardly from an interior of sidewalls 76. Ribs 78 circumscribe tube 12 and partially project into movable seal 20. In the exemplary embodiment, snorkel 10 includes six ribs spaced 60 degrees apart from one another. Ribs 78 guide movement of sealer member 18 between the closed position and the open position.

Although sealer member 18 is preferably formed as a single unitary body, sealer member 18 may alternatively be formed from separate components which are coupled or secured to one another. Furthermore, although less desirable, sealer member 18 may have other configurations so long as sealer member 18 provides a sealing surface such as sealing surface 34, provides a hollow interior in communication with the interior 24 of tube 12 and is movable between the closed position and the open position.

Movable seal 20 preferably comprises a cup-shaped member having a lower end 86 sealably secured to tube 12 and an upper end 88 sealably secured to sealer member 18. As previously described, in the exemplary embodiment, movable seal 20 includes internal ribs 48 and external ribs 84 for sealably coupling movable seal 20 to tube 12 and sealer member 18. To enable movement of sealer member 18 between the open and closed positions, movable seal 20 preferably includes a flexible membrane between ends 86 and 88 which enables movable seal 20 to expand and contract along the axis of tube 12. In the exemplary embodiment, movable seal 20 includes bellows portion 90 formed from a flexible material such as silicone. Alternatively, movable seal 20 may be formed from other materials such as flexible vinyl or polyvinyl chloride. Alternatively, movable seal 20 may comprise a balloon or sheath of flexible material enabling movable seal 20 to expand and contract between ends 86 and 88 along the axis of tube 12. In addition to being flexible or as an alternative to being flexible, the material forming movable seal 20 between ends 88 and 86 may be elastic or stretchable.

In the exemplary embodiment, bellows portion 90 is preconfigured so as to resiliently bias sealer member 18 and surface 34 towards the closed position in which surface 34 is in sealing engagement with surface 32 of lid 16. As a result, sealer member 18 more quickly reacts towards the closed position when the snorkeler is diving. In the exemplary embodiment, the bellows of movable seal 20 is preferably molded in a fully expanded position such that gravitational force upon sealer member 18 from out of the water pushes down sealer member 18 in the open position. Virtually any upward force or change in pressure in sealer member 18 automatically causes sealer member 18 to move upward to the closed position.

Although less desirable, movable seal 20 may alternatively comprise other structures which enable sealer member 18 to move along tube 12 between the open and closed positions and which also form a seal between sealing member 18 and tube 12. In alternative embodiments, movable seal 20 may alternatively comprise conventionally known sealing devices such as O-rings and the like, or may comprise later developed movable sealing technologies.

Figure 5:
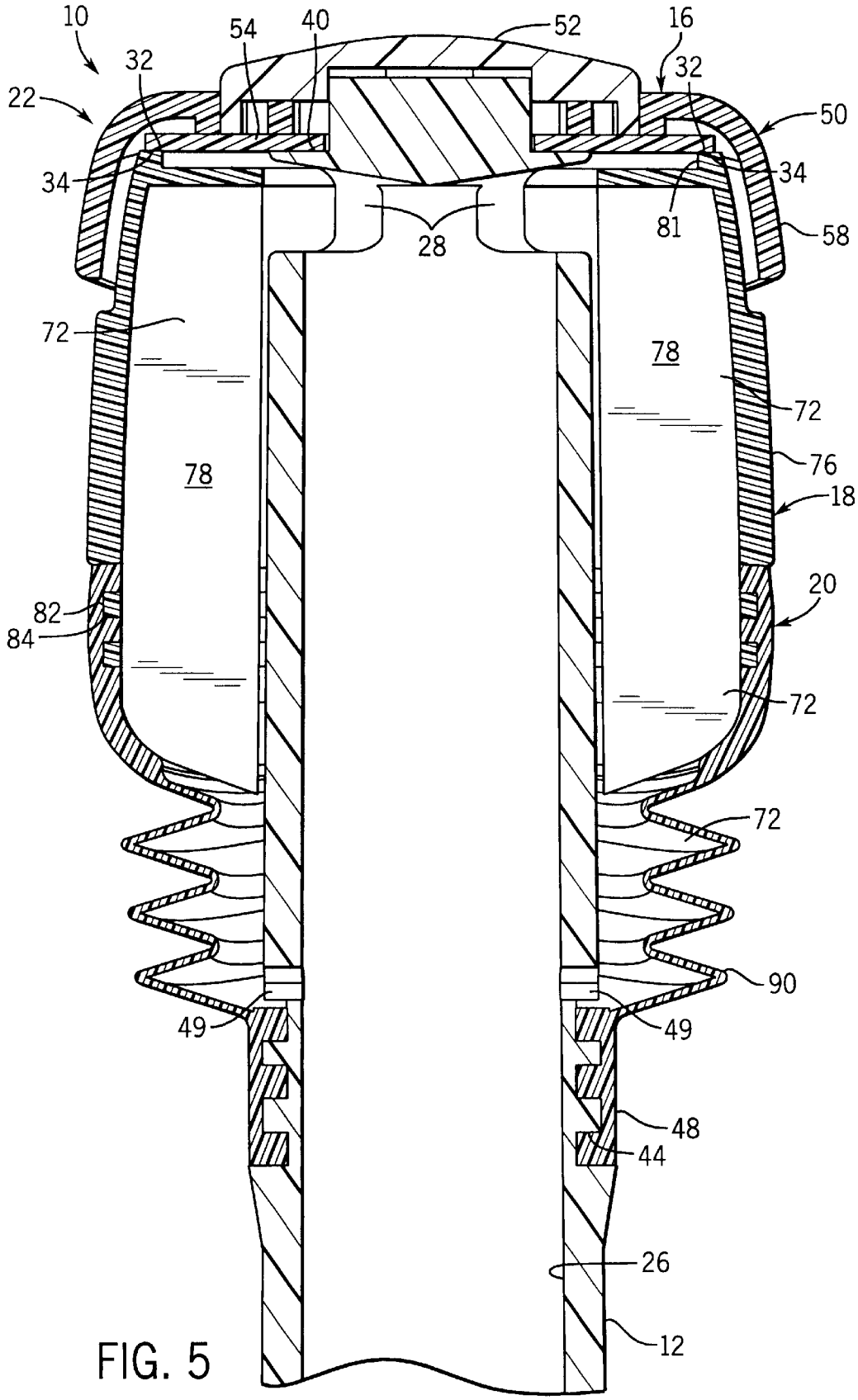
FIG. 5 illustrates a snorkel of FIG. 4 in an occluded or closed position while submerged.
Figure 6:
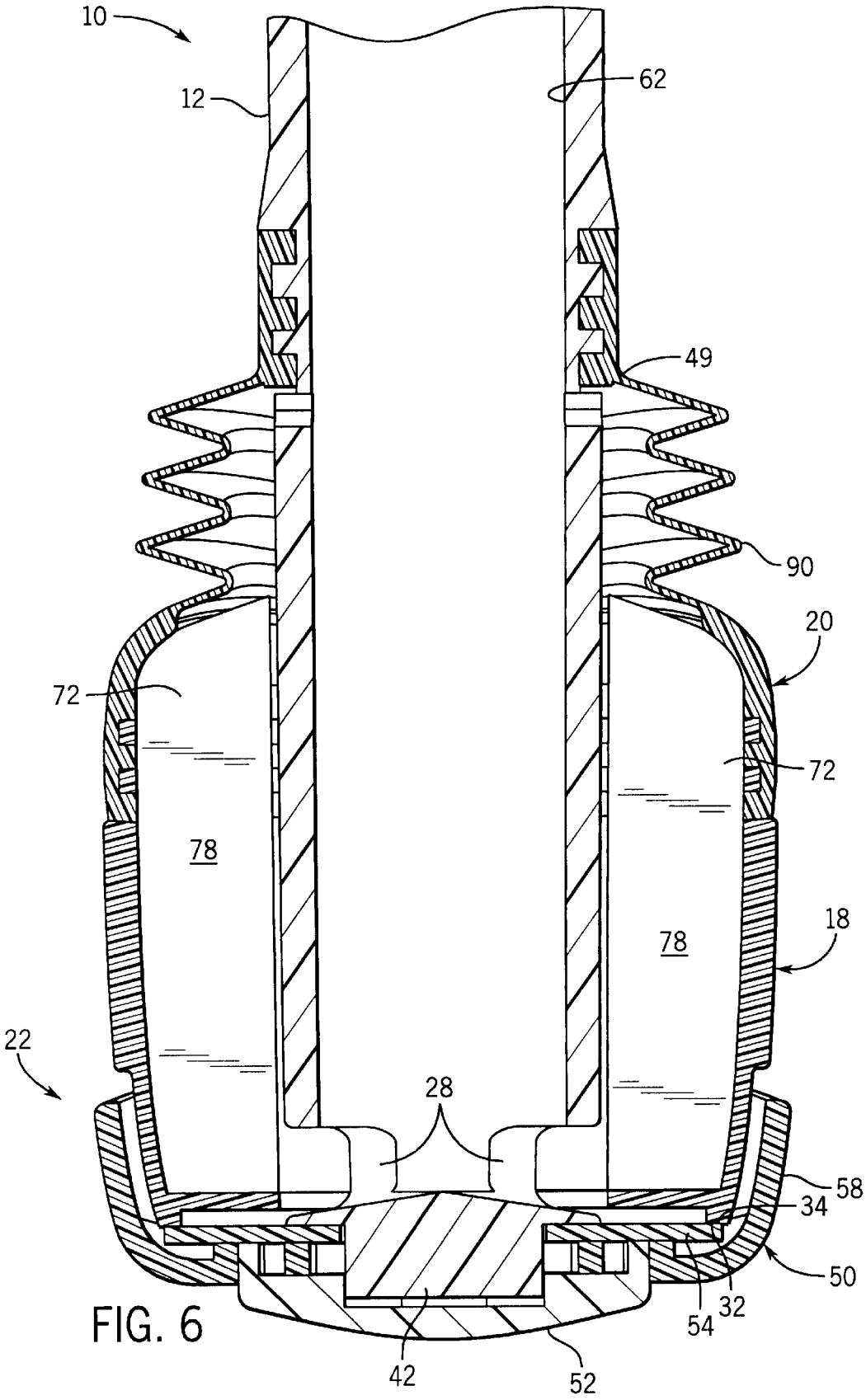
FIG. 6 illustrates a snorkel of FIG. 5 in the occluded or closed position while submerged.

FIGS. 4–6 illustrate the operation and advantages of snorkel 10. FIG. 4 depicts snorkel 10 with sealer member 18 in the open position typically when the snorkeler is snorkeling along the water surface with end 22 of tube 12 above the water surface, allowing the snorkeler to inhale and exhale air taken through snorkel 10. In the open position, sealer member 18 is positioned closer to end 24 of tube 12 as compared to when sealer member 18 is in the closed position. As a result, surfaces 32 and 34 are spaced apart from one another such that ports 28 remain unoccluded in that air is permitted to freely pass through ports 28 between passageway 26 and the ambient air surrounding end 22 of snorkel 10 above the water. In particular, air is permitted to pass between passageway 26 and the ambient air in the directions indicated by arrows 94. As best shown by FIG. 4, sidewalls or perimeter 58 of shield 50 merely overlap and extend below sealing surface 34 of sealer member 18 when sealer member 18 is in the open position by a distance D of approximately 0.15 inches. Ports 28 have an uppermost portion located slightly above surfaces 34 when sealer member 18 is in the open position shown. The most constricted portion through which air must travel between passageway 26 and the ambient air is generally between sidewall 58 and the upper portion of sealer member 18. This constriction has a width of approximately 0.075. However, because the annular gap between sidewall 58 and upper portion of sealer member 18 has an area greater than cross-sectional area of passageway 26, intake of air is not constricted. Moreover, because of the minimum overlap between sealer member 18 and sidewall 58 when sealer member 18 is in the open position, air passing in the direction indicated by arrow 94 includes less bends, twists or turns which enables easier, less restricted inhaling and exhaling of air through snorkel 10.

FIGS. 5 and 6 illustrate sealer member 18 of snorkel 10 in the closed position. FIG. 5 illustrates sealer member 18 in the closed position when snorkel 10 is in an upright position where it is below the surface of the water. FIG. 6 illustrates sealer member 18 in the closed position when snorkel 10 is upside down below the surface of the water. As shown by FIGS. 5 and 6, sealer member 18 automatically moves to the closed position in response to pressure differentials between interior of snorkel 10 (passageway 26 and interior 72 of sealer member 18 and movable seal 20) and the exterior of snorkel 10 (i.e., the water pressure surrounding snorkel 10). Because snorkel 10 closes itself automatically in response to pressure differentials rather than relying upon buoyancy of a particular material, snorkel 10 automatically closes or seals itself when under the water in almost any orientation including a vertical orientation as shown in FIG. 5, an upside down orientation as shown in FIG. 6, or a sideways or any orientation therebetween such as a sideways or angled orientation. As shown in FIG. 5, sealing surface 34 of sealer member 18 seals against surface 32 along a first seal line 96 so as to enclose or bound an occlusion area having a diameter D1. As further shown by FIG. 5, sealer member 18 is sealed against tube 12 along a second seal line 98 that encircles or bounds an area that has a diameter D2. The occlusion area, defined by the seal line created when the surfaces 32 and 34 seal against one another, is larger than the tube seal area, defined by the juncture of the sealer member 18 and tube 12. When sealer member 18 and snorkel 10 are submerged below the water surface, the pressure differential is created such that the interior 72 of sealer member 18 has lower pressure. This lower pressure is further reduced as the snorkeler attempts to inhale. The lower air pressure within interior 72 of sealer member 18 creates internal forces acting against the occlusion area and the tube sealing area. Because the occlusion area is greater than the tube sealing area, a greater force is exerted in the direction towards surface 32 to move and retain sealing surface 34 against sealing surface 32 when snorkel 10 is submerged below the water surface. As shown in FIG. 6, this force created by the lower air pressure within the interior of sealer member 18 moves and retains sealing surface 34 against sealing surface 32 even when snorkel 10 is submerged below the water in a substantially upside down orientation. Because snorkel 10 utilizes the force created by air pressure differentials, rather than buoyancy, to move sealing surface 34 into the occluded or closed position, snorkel 10 prevents water from undesirably passing into the interior 24 of tube 12 when snorkel 10 is positioned sideways or inverted. Thus, snorkel 10 provides a more reliable sealing when the snorkeler submerges.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A snorkel comprising:

a tube including a first end, a second e/d, and at least one internal passageway having a port; and a hollow member slidably supported proximate the first end, wherein the member moves between a closed position in which the member occludes the port and an open position in which the port is open and wherein the hollow member has an interior in communication with the internal passageway when the hollow member is in the closed position and wherein the hollow member is resiliently biased towards the closed position.

2. The snorkel of claim 1 including a lid coupled to the tube and partially shielding the port.

3. The snorkel of claim 2, wherein the port includes at least one radial opening and wherein the lid axially extends from above the opening to below the opening.

4. The snorkel of claim 1, wherein the hollow member has an upper end proximate the first end and a lower end proximate the second end, and wherein the lower end is sealed to an exterior surface of the tube.

5. The snorkel of claim 4 including a flexible membrane sealed to the exterior surface and the hollow member.

6. The snorkel of claim 5, wherein the flexible membrane includes a bellows.

7. The snorkel of claim 6, wherein the flexible membrane resiliently biases the hollow member towards the closed position.

8. The snorkel of claim 1, wherein the hollow member includes a first sealing surface, and wherein the snorkel includes a second sealing surface supported opposite the first sealing surface, wherein the first sealing surface and the second sealing surface engage one another along a first seal line that defines a first area when the hollow member is in the closed position, wherein the hollow member is sealed against the tube along a second seal line that defines a second area, and wherein the first area is greater than the second area.

9. The snorkel of claim 1 wherein the tube comprises one or more drainage holes so that the interior of the hollow member is in communication with the at least one internal passage way when the hollow member is in the open position and the closed position.

10. The snorkel of claim 1 further comprising a lid coupled to the tube by engagement of a pair of detents that bear against the top of the lid.

11. A snorkel comprising:

a mouthpiece;

a tube coupled to the mouthpiece, the tube including a first end, a second end proximate the mouthpiece and at least one internal passageway having a port and extending from the first end to the second end;

a first sealing surface extending above the port;

a sealer member extending about the tube below the port, the sealer member having a second sealing surface; and a flexible membrane sealed to the sealer member and the tube, wherein the sealer member moves between an open position in which air is allowed to pass through the port into the internal passageway and a closed position in which the second sealing surface engages the first sealing surface to block the port;

wherein the second sealing surface is resiliently biased towards the first sealing surface.

12. The snorkel of claim 11, wherein the flexible membrane comprises a bellows.

13. The snorkel of claim 11 including a lid coupled to the tube and partially shielding the port.

14. The snorkel of claim 11, wherein the first sealing surface and the second sealing surface engage one another along a first seal line that defines a first area, wherein the flexible membrane engages an exterior of the tube along a second seal line that defines a second area, and wherein the first area is greater than the second area.

15. A snorkel comprising:

a mouthpiece;

a tube coupled to the mouthpiece, the tube including a first end, a second end proximate the mouthpiece, and at least one internal passageway having a port;

a lid coupled to the tube proximate the first end, the lid providing a first sealing surface;

a sealer member extending about the tube and providing a second sealing surface opposite the first sealing surface, wherein the sealer member moves between a closed position in which the second sealing surfaces engages the first sealing surface to block the port and an open position in which air is allowed to pass through the port into the internal passageway, wherein the sealer member has an interior in communication with the internal passageway when the sealer member is in the closed position; and a flexible membrane sealed to the sealer member and the tube, wherein the flexible membrane resiliently biases the sealer member towards the closed position.

16. The snorkel of claim 15, wherein the lid extends from above to below the port.

17. The snorkel of claim 15, wherein the flexible membrane includes a bellows.

18. The snorkel of claim 15, wherein the lid is removably mounted upon the tube.

19. The snorkel of claim 15, wherein the lid includes an elastomeric sealing ring which provides the first sealing surface.

20. A snorkel comprising:

a tube including a first end, a second end, and at least one internal passageway having a port; and a hollow member slidably supported proximate the first end, wherein the member moves between a closed position in which the member occludes the port and an open position in which the port is open and wherein the hollow member has an interior in communication with the internal passageway when the hollow member is in the closed position;

wherein the port includes at least one radial opening and wherein the lid axially extends from above the opening to below the opening.

* * * * *

UNITED STATES PATENT AND TRADEMARK OFFICE

CERTIFICATE OF CORRECTION

PATENT NO. : 6,655,378 B2
DATED : December 2, 2003
INVENTOR(S) : Thomas R. Swetish It is certified that error appears in the above-identified patent and that said Letters Patent is hereby corrected as shown below:

Column 8,
Line 25, please replace "e/d" with -- end --

Column 10,
Line 34, please insert -- a lid coupled to the tube and partially shielding the port -- before "wherein the port"

Signed and Sealed this

Twenty-seventh Day of July, 2004

JON W. DUDAS
*Acting Director of the United States Patent and Trademark Office*